US005756432A

United States Patent [19]

Born et al.

[11] Patent Number: 5,756,432

[45] Date of Patent: May 26, 1998

[54] COLLOIDAL CALCIUM HYDROXIDE, ITS PREPARATION AND USES

[75] Inventors: Maurice Born, Nanterre; Agnès Chivé, Le Bourget; Bruno Delfort, Paris, all of France

[73] Assignee: Institut Francais du Petrole, Rueil Malmaison, France

[21] Appl. No.: 498,769

[22] Filed: Jul. 6, 1995

[30] Foreign Application Priority Data

Jul. 6, 1994 [FR] France ..... 94 08448

[51] Int. Cl.[6] ..... C10M 103/00; C10M 105/72; B01J 13/00

[52] U.S. Cl. ..... 508/391; 508/387; 252/306; 252/308; 252/309

[58] Field of Search ..... 252/306, 308, 252/309; 562/97, 33; 508/391, 387; 210/643

[56] References Cited

U.S. PATENT DOCUMENTS

| | | | |
|---|---|---|---|
| 2,779,784 | 1/1957 | Sharrah | 562/97 |
| 2,944,023 | 7/1960 | Kolarik | 508/178 |
| 3,021,277 | 2/1962 | Hoeppel | 507/138 |
| 3,021,280 | 2/1962 | Carlyle | 252/33 |
| 3,719,596 | 3/1973 | Shore et al. | 562/97 |
| 4,360,448 | 11/1982 | Li et al. | 210/643 |
| 4,474,710 | 10/1984 | Park et al. | 562/97 |
| 4,557,872 | 12/1985 | Marsh et al. | 562/33 |
| 4,614,597 | 9/1986 | Stuart et al. | 562/97 |
| 4,615,841 | 10/1986 | Stamatakis et al. | 562/97 |
| 5,320,763 | 6/1994 | Campbell | 252/39 |

FOREIGN PATENT DOCUMENTS

| | | | |
|---|---|---|---|
| 1187822 | 4/1970 | United Kingdom | 252/308 |

OTHER PUBLICATIONS

D. Myers, Surfactant Science and Technology Second Edition, VHC Publishers, NY, NY, pp. 81–131, 1992.

"Process for Preparing Calcium Hydroxide Dispersons in Oil–Soluble Calcium Sulfonate Solutions", U.S. Patent Office, Defensive Publication 915 O.G. 384, T915.005, Oct. 9, 1973.

*Primary Examiner*—Richard D. Lovering
*Assistant Examiner*—Daniel S. Metzmaier
*Attorney, Agent, or Firm*—Millen, White, Zelano, & Branigan, P.C.

[57] ABSTRACT

Novel colloidal products are described, containing calcium hydroxide in the center of micelles which are stabilised in an organic medium by a shell of a surfactant, in a reversed micelle. The products are obtained by reacting calcium oxide CaO, calcium hydride $CaH_2$ or calcium metal with water in an organic medium in the present of a surfactant such as an alkine-earth or alkali metal alkylaryl sulphonate. They are used mainly as synthesis intermediates in reactions requiring lime to be introduced into an organic medium, or as detergent additives in lubricating oils.

29 Claims, 1 Drawing Sheet

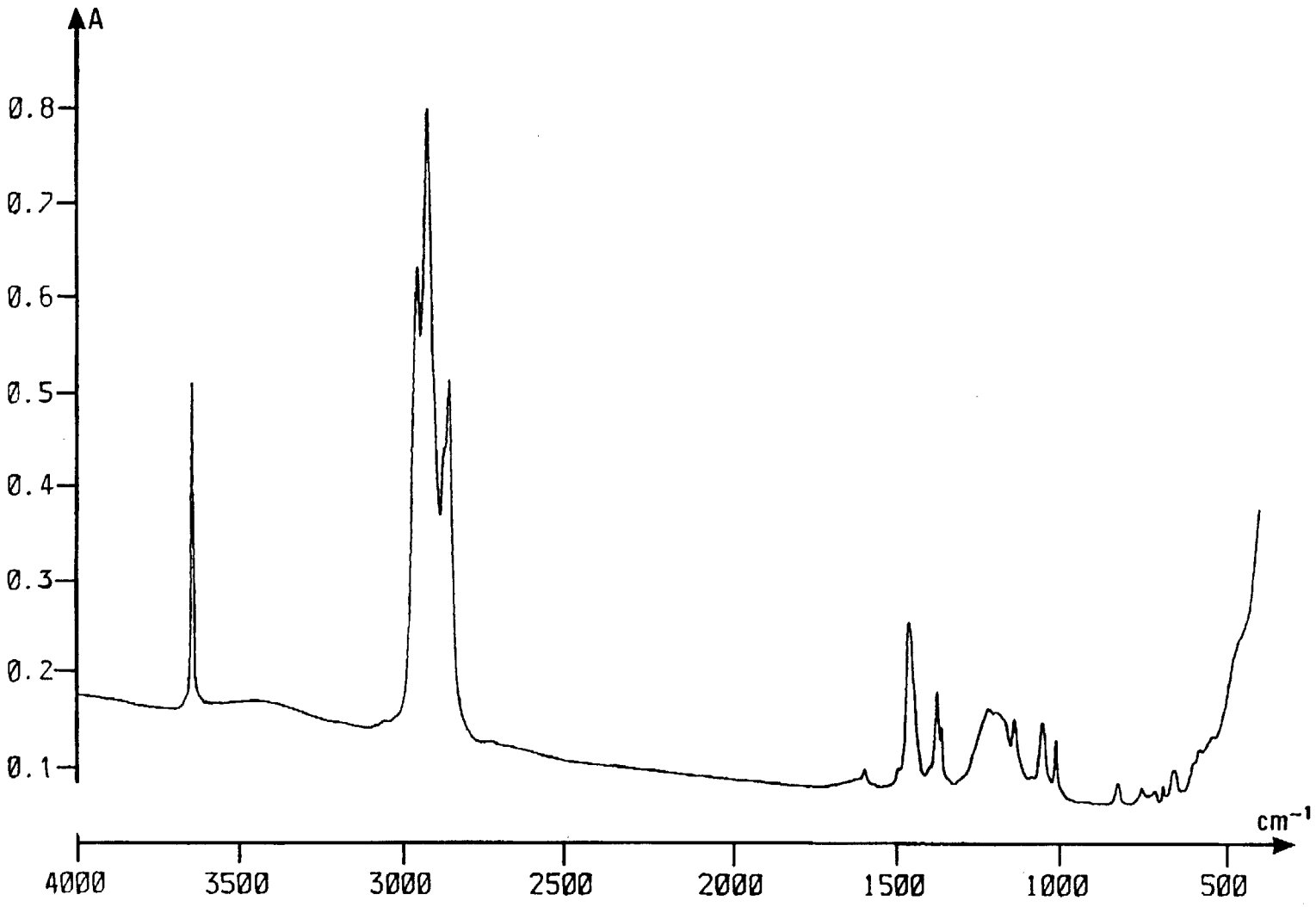
A
0.8
0.7
0.6
0.5
0.4
0.3
0.2
0.1
4000
3500
3000
2500
2000
1500
1000
500
cm⁻¹

COLLOIDAL CALCIUM HYDROXIDE, ITS PREPARATION AND USES

BACKGROUND OF THE INVENTION

The invention concerns novel colloidal products containing mainly lime in the centre of micelles which are stabilised in an organic medium by a surfactant, in a reversed micelle.

Calcium hydroxide $Ca(OH)_2$ can be produced by the reaction of water with certain calcium compounds such as quick lime (calcium oxide) CaO or calcium hydride $CaH_2$, or calcium metal. The reactions are as follows:

$$CaO+H_2O \rightarrow Ca(OH)_2$$

$$CaO_2+H_2O \rightarrow Ca(OH)_2+2H_2$$

$$Ca+2HO \rightarrow Ca(OH)_2+H_2$$

Colloidal calcium compounds are known in the art, for example calcium carbonate or calcium borate, obtained respectively by the reaction of carbonic acid or boric acid on lime, CaO or $Ca(CH)_2$, in the presence of surfactants.

SUMMARY OF THE INVENTION

We have now discovered that colloidal products containing calcium in the form of the hydroxide $Ca(OH)_2$ can be prepared.

The products of the invention can be defined in general in that they consist of colloidal products containing calcium hydroxide in the centre of micelles stabilised in an organic medium by a shell of surfactant, in a reversed micelle.

Colloidal lime-containing products in accordance with the invention can be prepared by reacting calcium oxide CaO, calcium hydride $CaH_2$ or calcium metal with water, in an organic medium in the presence of a surfactant consisting in general of a sulphonate of calcium, or a further alkaline-earth or alkali metal; more particularly, alkylaryl sulphonates are used.

Organic media in which the "colloidal lime" of the invention can be formed are:

aliphatic hydrocarbons such as hexanes or heptanes;

cycloaliphatic hydrocarbons such as cyclohexane;

aromatic hydrocarbons such as toluene or xylenes;

halogenated hydrocarbons, for example chlorinated hydrocarbons such as monochloro- or dichlorobenzene, or dichloro- or trichloroethane;

heterocyclic compounds such as tetrahydrofuran.

More particularly, the surfactant can be an alkylaryl sulphonate of an alkali metal (sodium or potassium) or an alkaline-earth metal (magnesium, calcium or barium).

A calcium alkylaryl sulphonate can be formed in situ by reaction between an alkylaryl sulphonic acid and the calcium hydroxide formed in the medium.

The reaction can be advantageously carried out in the presence of a promoter, for example an aliphatic monoalcohol such as methanol. In addition, a mineral or synthetic diluting oil can be used.

The reaction temperature is generally between 0° and 80° C., usually between 5° C. and 45° C.

The products of the invention generally have a calcium content which can be as much as about 35% of the mass with respect to the active matter (centre of the micelle constituted by calcium hydroxide+surfactant, excluding any diluting oil added).

The alkali reserve of the products in diluted form in an oil at a concentration of 30 to 60% by weight of the active matter corresponds to a TBN (Total Base Number) of about 100 to 500, usually 200 to 400 mg of potassium hydroxide per gram of product, as measured using standard ASTM D-2896.

The structure of the lime $Ca(OH)_2$ constituting the centre of the micelle is confirmed by infrared analysis.

Finally, the sulphur content in the products from the alkylaryl sulphonate used as a surfactant can be, for example, 1% to 5% by weight with respect to the active material.

The products of the invention, which are of interest since they constitute a source of lime dispersed in an organic medium, can be used in any known application for calcium carbonates, in particular as detergent additives in lubricating oils. They can also be used as synthesis intermediates in a variety of reactions requiring the introduction of lime into an organic medium.

BRIEF DESCRIPTION OF THE DRAWING

The FIGURE is an infrared spectrum of a product of the invention.

The following examples illustrate the invention. Preliminary example A describes the synthesis of a calcium alkylaryl sulphonate used as the surfactant in Examples 1 to 3.

EXAMPLE A

Synthesis of a Calcium Alkylaryl Sulphonate 250 g (0.357 mole) of an alkylaryl sulphonic acid with an equivalent average molar weight of 700, 256.7 g of a neutral 130 oil, 37 g (0.50 mole) of lime $Ca(OH)_2$, 500 ml of toluene and 30 ml of methanol were introduced into a reactor provided with a stirrer and a Dean-Stark separator. The medium was heated to the methanol distillation point then to that for the water formed by neutralisation of the sulphonic acid. After returning to room temperature, the medium was filtered and the solvent was eliminated under reduced pressure. 503 g of a calcium alkylaryl sulphonate was produced which contained:

Ca=1.4% by weight

S=2.2% by weight

EXAMPLE 1

40 g of the product prepared in Example A was introduced into a reactor provided with a stirrer and a means for introducing a solid, and dissolved in 100 ml of 1,1,2-trichloroethane. 2.8 g (0.156 mole) of water was introduced with stirring, then 15 g of lime CaO over 3 hours at a temperature of between 20° C. and 40° C. After filtering the medium, the solvent was eliminated under reduced pressure. A homogeneous product was obtained with the following characteristics:

Ca=9.0% by weight

S=1.9% by weight

The alkali reserve was 230 mg KOH/g of product (TBN method ASTM 2896). The infrared spectrum of the product is shown in FIG. 1. The wave number ($cm^{-1}$) is shown as the abscissa and the absorbence (A) as the ordinate.

Examination of this spectrum confirmed the structure of the micellised product (a signal at 3643 $cm^{-1}$ due to the hydroxy groups in the lime $Ca(OH)_2$).

EXAMPLE 2

40 g of the product prepared in Example A was introduced into a reactor provided with a stirrer and a means for introducing a solid, and dissolved in 100 ml of 1,1,2-trichloroethane. 2.8 g (0.156 mole) of water was introduced with stirring, then 3.15 g (0.075 mole) of calcium hydride $CaH_2$ over 4 hours at a temperature of between 5° C. and 15° C. After filtering the medium, the solvent was eliminated under reduced pressure. A homogeneous product was obtained with the following characteristics:

Ca=6.0% by weight

S=2.2% by weight

The alkali reserve was 140 mg KOH/g of product (TBN method ASTM 2896).

Examination of an analogous infrared spectrum to that of Example 1 confirmed the structure of the product.

EXAMPLE 3

40 g of the product prepared in Example A was introduced into a reactor provided with a stirrer and a means for introducing a solid, and dissolved in 100 ml of 1,1,2-trichloroethane. 2.8 g (0.156 mole) of water was introduced at the same time as 15 g (0.267 mole) of lime CaO, with stirring, keeping the temperature below 10° C. The medium was held at this temperature for 3 hours. After filtering the medium, the solvent was eliminated under reduced pressure. A homogeneous product was obtained with the following characteristics:

Ca 10.5% by weight

S=1.2% by weight

The alkali reserve was 283 mg KOH/g of product (TBN method ASTM 2896).

Examination of an analogous infrared spectrum to that of Example 1 confirmed the structure of the product.

EXAMPLE 4

28 g of an alkylaryl sulphonic acid with an equivalent average molar weight of 700, 200 ml of toluene, 10 ml of methanol and 60 g of a 130 neutral mineral oil were introduced into a reactor provided with a stirrer and a dropping funnel. 30 g (0.714 mole) of calcium hydride $CaH_2$ was dispersed in the medium. A solution of 23.4 g (1.28 mole) of water in 150 ml of tetrahydrofuran was introduced via the dropping funnel over 5 hours, with stirring, at a temperature not exceeding 20° C. The medium was held at this temperature for 3 hours. After filtering, the solvent was eliminated under reduced pressure. A homogeneous product was obtained with the following characteristics:

Ca=14.6% by weight

S=1.4% by weight

The alkali reserve was 413 mg KOH/g of product (TBN method ASTM 2896).

Examination of an analogous infrared spectrum to that of Example 1 confirmed the structure of the product.

EXAMPLE 5

28 g of an alkylaryl sulphonic acid with an equivalent molar weight of 700, 200 ml of toluene, 10 ml of methanol and 60 g of a 130 neutral mineral oil were introduced into a reactor provided with a stirrer and a dropping funnel. 28.6 g (0.714 mole) of calcium metal was dispersed in the medium. A solution of 23.4 g (1.28 mole) of water in 150 ml of tetrahydrofuran was introduced via the dropping funnel over 5 hours, with stirring, at a temperature not exceeding 20° C. The medium was held at this temperature for 4 hours. After filtering, the solvent was eliminated under reduced pressure. A homogeneous product was obtained with the following characteristics:

Ca 4.95% by weight

S 1.91% by weight

The alkali reserve was 108 mg KOH/g of product (TBN method ASTM 2896).

Examination of an analogous infrared spectrum to that of Example 1 confirmed the structure of the product.

We claim:

1. A colloidal product comprising calcium hydroxide $Ca(OH)_2$ in the center of micelles stabilized in an organic medium by a shell of a surfactant, in a reversed micelle, and having a base number corresponding to a TBN of 100 to 500 mg of potassium hydroxide per gram of product, in accordance with ASTM D-2896.

2. A colloidal product according to claim 1, wherein said surfactant is selected from the group consisting of alkylaryl sulphonates of alkaline earth metals and alkylaryl sulphonates of alkali metals.

3. A colloidal product according to claim 1, wherein said organic medium comprises at least one organic solvent selected from the group consisting of aliphatic, cycloaliphatic or aromatic hydrocarbons, which may be chlorinated, and heterocyclic compounds which are liquid at normal temperatures.

4. A colloidal product according to claim 3, wherein said organic solvent is selected from the group consisting of hexanes, heptanes, cyclohexane, toluene, xylenes, monochlorobenzene, dichlorobenzene and tetrahydrofuran.

5. A colloidal product according to claim 1, wherein said colloid product is obtained by reacting calcium oxide CaO, calcium hydride $CaH_2$ or calcium metal with water in an organic medium in the presence of a surfactant.

6. A colloidal product according to claim 5, wherein said calcium oxide CaO is reacted with water.

7. A colloidal product according to claim 5, wherein said calcium hydride $CaH_2$ is reacted with water.

8. A colloidal product according to claim 5, wherein said calcium metal is reacted with water.

9. A colloidal product according to claim 5, wherein the reaction is carried out at a temperature of 0° C. to 85° C.

10. A colloidal product according to claim 5, wherein said surfactant comprises a calcium alkylaryl sulphonate.

11. A colloidal product according to claim 10, wherein the calcium alkylaryl sulphonate is formed in situ by reacting an alkylaryl sulphonic acid with the calcium hydroxide formed in the medium.

12. A colloidal product according to claim 10, wherein the surfactant is dissolved in an organic solvent to form a solution and CaO and water are then introduced into the solution with stirring at a temperature not exceeding 40° C. and for a sufficient time to form the colloidal product.

13. A colloidal product according to claim 1, wherein said colloid product is diluted in an oil at a concentration of 30% to 60% by weight.

14. A colloidal product according to claim 13, having a base number corresponding to a TBN of 200 to 400 mg of potassium hydroxide per gram of product, in accordance with ASTM D-2896.

15. A lubricant comprising a major proportion of a lubricating oil and, as a detergent additive, a minor proportion of a colloidal product as claimed in claim 1.

16. A colloidal product according to claim 1 having an infrared spectrum showing a signal at 3643 $cm^{-1}$.

17. A colloidal product according to claim 1 having an infrared spectrum according to the figure in the drawing.

18. A process for the preparation of a colloidal product according to claim 1, comprising reacting calcium oxide, calcium hydride or calcium metal with water, in an organic medium in the presence of a surfactant.

19. A process according to claim 18, comprising reacting calcium hydride with water, in an organic medium, in the presence of a surfactant.

20. A process according to claim 19, wherein the surfactant is a calcium sulfonate.

21. A process according to claim 19, wherein the surfactant is an alkylaryl sulfonate of calcium.

22. A process according to claim 18, wherein said surfactant is selected from the group consisting of alkylaryl sulfonates of alkaline-earth metals and alkylaryl sulfonates of alkali metals.

23. A process according to claim 18, wherein said organic medium comprises at least one organic solvent selected from the group consisting of aliphatic, cycloaliphatic or aromatic hydrocarbons, which may be chlorinated, and heterocyclic compounds which are liquid at normal temperatures.

24. A process according to claim 18, wherein said organic solvent is selected from the group consisting of hexanes, heptanes, cyclohexane, toluene, xylenes, monochlorobenzene, dichlorobenzene and tetrahydrofuran.

25. A process according to claim 18, wherein calcium oxide CaO is reacted with water.

26. A process according to claim 18, wherein said calcium metal is reacted with water.

27. A process according to claim 18, wherein the reaction is carried out at a temperature of 0° C. to 85° C.

28. A process according to claim 18, wherein said surfactant comprises a calcium alkylaryl sulfonate.

29. A process according to claim 18, wherein the calcium alkylaryl sulfonate is formed in situ by reacting an alkylaryl sulphonic acid with the calcium hydroxide formed in the medium.

* * * * *